US008923536B2

(12) United States Patent
Kim et al.

(10) Patent No.: US 8,923,536 B2
(45) Date of Patent: Dec. 30, 2014

(54) METHOD AND APPARATUS FOR LOCALIZING SOUND IMAGE OF INPUT SIGNAL IN SPATIAL POSITION

(75) Inventors: Young-tae Kim, Seongnam-si (KR); Sang-wook Kim, Seoul (KR); Jung-ho Kim, Yongin-si (KR); Sang-chul Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1575 days.

(21) Appl. No.: 11/889,431

(22) Filed: Aug. 13, 2007

(65) Prior Publication Data

US 2008/0181418 A1 Jul. 31, 2008

(30) Foreign Application Priority Data

Jan. 25, 2007 (KR) ..... 10-2007-0007911

(51) Int. Cl.
*H04R 5/02* (2006.01)
*H04S 7/00* (2006.01)

(52) U.S. Cl.
CPC ..... *H04S 7/302* (2013.01); *H04S 2420/03* (2013.01); *H04S 2420/01* (2013.01); *H04R 2499/11* (2013.01)
USPC ..... 381/309; 381/26; 381/74; 381/310

(58) Field of Classification Search
USPC ..... 381/17, 1, 18, 19, 309, 26, 74, 310
See application file for complete search history.

(56) References Cited

U.S. PATENT DOCUMENTS 5,982,903 A * 11/1999 Kinoshita et al. ..... 381/18
6,118,875 A * 9/2000 Møller et al. ..... 381/1

(Continued)

FOREIGN PATENT DOCUMENTS

KR 10-2000-0031217 6/2000
KR 10-2006-0004528 1/2006

OTHER PUBLICATIONS

Notice of Allowance, dated Aug. 18, 2008, in corresponding Korean Application No. 10-2007-0007911.

*Primary Examiner* — Vivian Chin
*Assistant Examiner* — Con P Tran
(74) *Attorney, Agent, or Firm* — Staas & Halsey LLP

(57) ABSTRACT

A method and apparatus for localizing a sound image of an input signal to a spatial position are provided. The method of localizing a sound image to a spatial position includes: extracting from a head related impulse response (HRIR) measured with respect to changes in the position of a sound source, first information indicating a reflection sound wave reflected by the body of a listener; extracting from the HRIR second information indicating the difference between sound pressures generated in two ears, respectively, when a direct sound wave generated from the position of the sound source arrives at the two ears, respectively, of the listener; extracting third information indicating the difference between times taken by the direct sound wave to arrive at the two ears, respectively, from the HRIR; and localizing a sound image of an input signal to a spatial position by using the extracted information. According to the method and apparatus of the present invention, by using only important information having influence on sound image localization of a virtual sound source extracted from the HRIR, the sound image of the input signal can be localized to a spatial position with a small number of filter coefficients.

6 Claims, 12 Drawing Sheets
(4 of 12 Drawing Sheet(s) Filed in Color)

(56) References Cited

U.S. PATENT DOCUMENTS

| | | | | |
|---|---|---|---|---|
| 6,173,061 | B1 * | 1/2001 | Norris et al. | 381/309 |
| 7,313,241 | B2 * | 12/2007 | Hamacher et al. | 381/60 |
| 7,720,229 | B2 * | 5/2010 | Duraiswami et al. | 381/17 |
| 2004/0113966 | A1 | 6/2004 | Chung | |
| 2005/0100171 | A1 * | 5/2005 | Reilly et al. | 381/63 |
| 2006/0018497 | A1 * | 1/2006 | Kornagel | 381/315 |
| 2006/0120533 | A1 * | 6/2006 | Chen | 381/17 |

* cited by examiner

MEASURED HRIR

METHOD AND APPARATUS FOR LOCALIZING SOUND IMAGE OF INPUT SIGNAL IN SPATIAL POSITION

CROSS-REFERENCE TO RELATED PATENT APPLICATIONS

This application claims the benefit of Korean Patent Application No. 10-2007-0007911, filed on Jan. 25, 2007, in the Korean Intellectual Property Office, the disclosure of which is incorporated herein in its entirety by reference.

BACKGROUND

1. Field of the Invention

The present invention relates to a method and apparatus for localizing a sound image of an input signal to a spatial position, and more particularly, to a method and apparatus by which only important information having influence on sound image localization of a virtual sound source is extracted, and by using the extracted information, a sound image of an input signal is localized to a spatial position with a small number of filter coefficients.

2. Description of the Related Art

When virtual stereo sound (3-dimensional (3D) sound) for localizing a sound source in a 3D space is implemented, a measured head related impulse response (HRIR) is generally used. The measured HRIR is a transfer function relating the eardrums of a listener with respect to the position of a sound source, and includes many physical effects having influence on the hearing characteristic of the listener from when the sound wave is generated by a sound source until it is transferred to the eardrums of the listener. This HRIR is measured with respect to changes in the 3D position of a sound source and changes in frequencies, by using a manikin that is made based on an average structure of a human body, and the measured HRIR is consisted of a database (DB) form. Accordingly, when a virtual stereo sound is actually implemented by using the measured HRIR DB, problems as described below occur.

When a sound image of one virtual sound source is localized to an arbitrary 3D position, a measured HRIR filter is used. In the case of multiple channels, the number of HRIR filters increases as the number of channels increases, and in order to implement accurate localization of a sound image, the coefficient of each filter also increases. This causes a problem in that a large capacity, high performance processor is required for the localization. Also, when a listener moves, a large capacity HRIR DB of HRIRs measured at predicted positions of the listener, and a large capacity, high performance processor capable of performing an interpolation algorithm in real time by using the large capacity HRIR DB are required.

SUMMARY OF THE INVENTION

The present invention provides a method and apparatus by which only important information having influence on sound image localization of a virtual sound source is extracted, and by using the extracted information, instead of experimentally obtained HRIR filters, a sound image of an input signal can be localized to a spatial position by using only a small capacity low performance processor.

The present invention also provides a computer readable recording medium having embodied thereon a computer program for executing the method.

The technological objectives of the present invention are not limited to the above mentioned objectives, and other technological objectives not mentioned can be clearly understood by those of ordinary skill in the art pertaining to the present invention from the following description.

According to an aspect of the present invention, there is provided a method of localizing a sound image of an input signal to a spatial position, the method including: extracting, from a head related impulse response (HRIR) measured with respect to changes in the position of a sound source, first information indicating a reflection sound wave reflected by the body of a listener; extracting, from the HRIR, second information indicating the difference between sound pressures generated in two ears, respectively, when a direct sound wave generated from the position of the sound source arrives at the two ears, respectively, of the listener; extracting, from the HRIR, third information indicating the difference between times taken by the direct sound wave to arrive at the two ears, respectively; and localizing a sound image of an input signal to a spatial position by using the extracted information.

According to another aspect of the present invention, there is provided a computer readable recording medium having embodied thereon a computer program for executing a method of localizing a sound image of an input signal to a spatial position.

According to another aspect of the present invention, there is provided an apparatus for localizing a sound image including: a first filter set by extracted first information after extracting, from an HRIR measured with respect to changes in the position of a sound source, the first information indicating a reflection sound wave reflected by the body of a listener; a second filter set by extracted second information after extracting from the HRIR, the second information indicating the difference between sound pressures generated in two ears, respectively, when a direct sound wave generated from the position of the sound source arrives at the two ears, respectively, of the listener; and a third filter set by third information after extracting, from the HRIR, the third information indicating the difference between times taken by the direct sound wave to arrive at the two ears, respectively, wherein a sound image of an input signal is localized by using the set first through third filters.

According to the present invention, by extracting and using only important information having influence on sound image localization of a virtual sound source, the apparatus and the method of the present invention can be embodied with a small number of filter coefficients. Also, the apparatus and the method of the present invention can be embodied only with a small capacity processor so as to be employed in a small capacity device, such as a mobile device.

BRIEF DESCRIPTION OF THE DRAWINGS

The patent or application file contains at least one drawing executed in color. Copies of this patent or patent application publication with color drawing(s) will be provided by the Office upon request and payment of necessary fee. The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
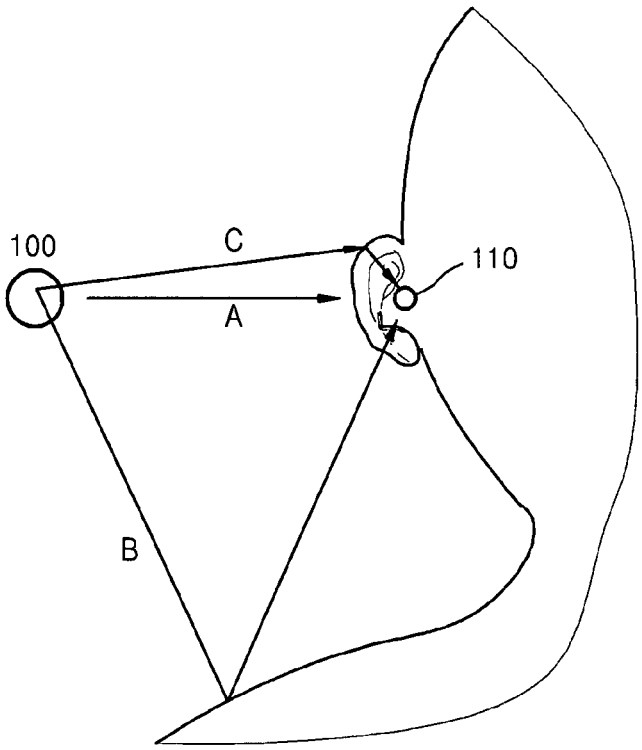
FIG. 1 is a diagram illustrating paths through which a sound wave used for sound image localization is transferred to the ears of a listener according to an embodiment of the present invention.

FIG. 1 is a diagram illustrating paths through which a sound wave used for sound image localization is transferred to the ears of a listener according to an embodiment of the present invention.

A sound source 100 illustrated in FIG. 1 indicates the position at which sound is generated. The sound wave generated in the sound source 100 is transferred to the ears of a listener, and the listener hears the sound generated at the sound source 100 through vibrations of the sound wave transferred to the eardrums 110 of the ears. In this case, the sound wave is transferred to the ears of the listener through a variety of paths, and in an embodiment of the present invention, the sound wave generated at the sound source 100 and transferred to the ears of the listener is classified into 3 types, and by using the classified sound wave, a sound image is localized. Here, sound image localization means localizing the position of a predetermined sound source heard by a person to a virtual position. In the current embodiment of the present invention, sound waves are classified into a direct sound wave, a first reflection sound wave which is reflected by the shoulders of a listener, and a second reflection sound wave which is reflected by the pinnae of the listener. As illustrated in FIG. 1, the direct sound wave is directly transferred to the ears of the listener through a path A. The first reflection sound wave is reflected by a shoulder of the listener and transferred to the ears of the listener through a path B. The second reflection sound wave is reflected by a pinna of the listener and transferred to the ears of the listener through a path C.

Figure 2:
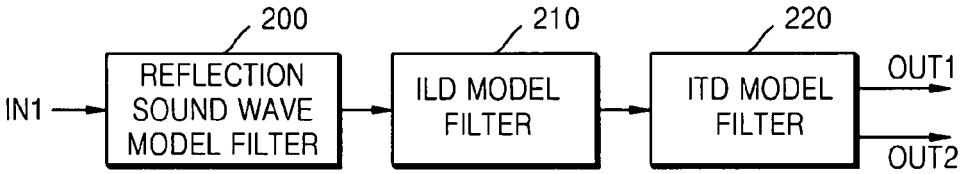
FIG. 2 is a schematic diagram illustrating an apparatus for localizing a sound image of an input signal to a spatial position according to an embodiment of the present invention.

FIG. 2 is a schematic diagram illustrating an apparatus for localizing a sound image of an input signal to a spatial position according to an embodiment of the present invention.

The apparatus for localizing a sound image of an input signal to a spatial position according to the current embodiment is composed of a reflection sound wave model filter 200, an interaural level difference (ILD) model filter 210, and an interaural time difference (ITD) model filter 220.

The reflection sound wave model filter 200 extracts information indicating a reflection sound wave reflected by the shoulders and pinnae of a listener, from a head related impulse response (HRIR) measured with respect to changes in the position of a sound source, and the reflection sound wave model filter 200 is set by using the extracted information. In this case, the HRIR is data obtained by measuring at the two ears, respectively, of the listener, an impulse response generated at a sound source, and indicates a transfer function between the sound and the eardrums of the listener.

The ILD model filter 210 extracts from the HRIR measured with respect to changes in the position of the sound source, information indicating the difference between sound pressures generated at the two ears, respectively, when a direct sound wave generated at the position of a sound source arrives at the two ears of the listener, and the ILD model filter 210 is set by using the extracted information.

The ITD model filter 220 extracts from the HRIR measured with respect to changes in the position of the sound source, information indicating the difference between times taken by the direct sound wave, generated at the position of the sound source, to arrive at the two ears of the listener, and by using the extracted information, the ITD model filter 220 is set.

A signal input through an input terminal IN 1 is filtered through the reflection sound wave model filter 200, the ILD model filter 210, and the ITD model filter 220, and then, applied to a left channel and a right channel, respectively, and then, output through output terminals OUT 1 and OUT 2.

Figure 3:
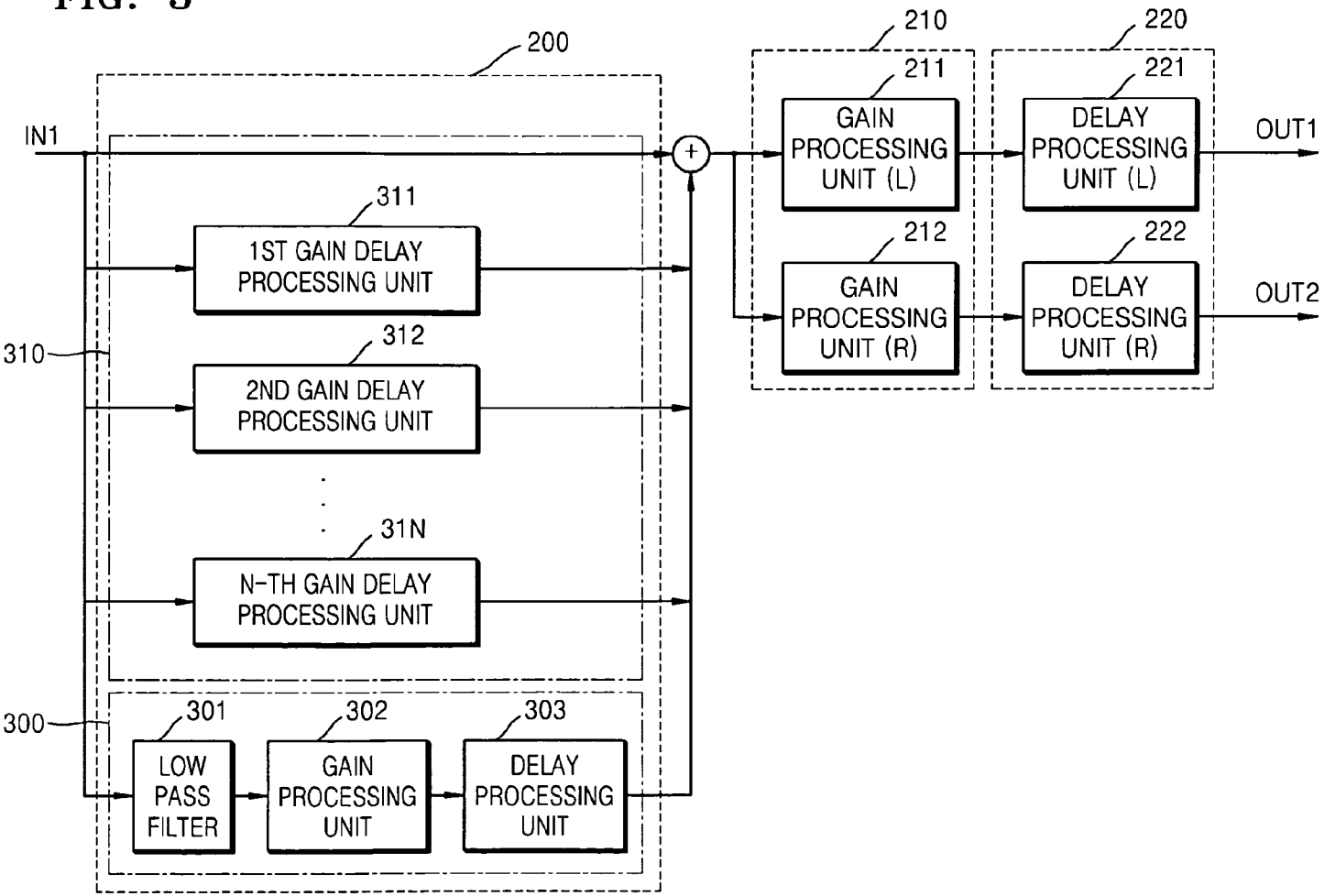
FIG. 3 is a detailed diagram illustrating an apparatus for localizing a sound image of an input signal to a spatial position according to an embodiment of the present invention.

FIG. 3 is a detailed diagram illustrating an apparatus for localizing a sound image of an input signal to a spatial position according to an embodiment of the present invention.

A reflection sound wave model filter 200 includes a first reflection sound wave model filter 300 and a second reflection sound wave model filter 310.

The first reflection sound wave model filter 300 extracts information on a first reflection sound wave indicating the degree of reflection due to the shoulder of a listener, from an HRIR measured with respect to changes in the position of the sound source, and by using the extracted first reflection sound wave information, the first reflection sound wave model filter 300 is set.

The first reflection sound wave model filter 300 includes a low pass filter 301, a gain processing unit 302, and a delay processing unit 303. The low pass filter 301 filters a signal input through an input terminal IN 1, and outputs a low frequency band signal. The gain of the output low frequency band signal is adjusted in the gain processing unit 302 and the delay of the signal is processed in the delay processing unit 303.

The second reflection sound wave model filter 310 extracts information on a second reflection sound wave reflected by the pinnae of the listener, from the HRIR measured with respect to changes in the position of the sound source, and by using the extracted second reflection sound wave information, the second reflection sound wave model filter 310 is set.

The second reflection sound wave model filter 300 includes a plurality of gain and delay processing units 311, 312, through to 31N. In the current embodiment, 3 gain and delay processing units are included, but the present invention is not necessarily limited to this. In the gain and delay processing units 311, 312, through to 31N, the gain of a signal input through the input terminal IN 1 is adjusted and the delay of the signal is processed, and then, the signal is output.

The ILD model filter 210 includes a gain processing unit (L) 211 adjusting a gain corresponding to a left channel, and a gain processing unit (R) 212 adjusting a gain corresponding to a right channel. The gain values of the gain processing unit (L) 211 and the gain processing unit (R) 212 are set by using the sound pressure ratio of transfer functions of two ears with respect to a sound source measured at a position in the frequency domain.

$$H_{HS}(\omega, \theta) = \left| \frac{X_{right}}{X_{left}} \right| \tag{1}$$

Here, $X_{right}$ is the sound pressure of the right ear measured in relation to a predetermined sound source, and $X_{left}$ is the sound pressure of the left ear.

The sound pressure ratio illustrated in equation 1 shows a value varying with respect to the position of a sound source.

The ITD model filter 220 includes a delay processing unit (L) 221 delaying a signal corresponding to a left channel, and a delay processing unit (R) 222 delaying a signal corresponding to a right channel.

The apparatus for localizing a sound image of an input signal to a spatial position sets the reflection sound wave model filter 200, the ILD model filter 210, and the ITD model filter 220 by using an HRIR measured with respect to changes in the position of a sound source. The process of localization will now be explained.

Figure 4A:
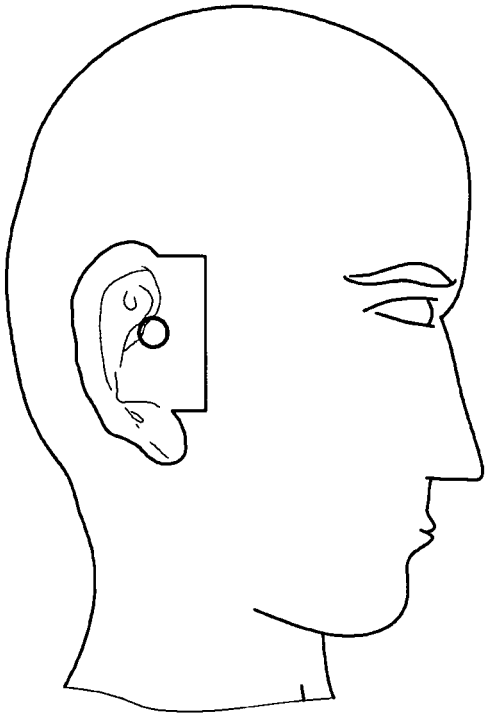
FIG. 4A is a diagram illustrating a dummy head with pinnae attached thereto according to an embodiment of the present invention.

FIG. 4A is a diagram illustrating a dummy head with pinnae attached thereto according to an embodiment of the present invention.

The dummy head is a doll made to have a shape similar to the head of a listener, in which instead of the eardrums of the listener, a high performance microphone is installed, thereby measuring an impulse response generated at a sound source and obtaining an HRIR with respect to the position of the sound source. As illustrated in FIG. 4A, an HRIR measured by using the dummy head to which pinnae are attached, includes a second reflection sound wave reflected by the pinnae.

Figure 4B:
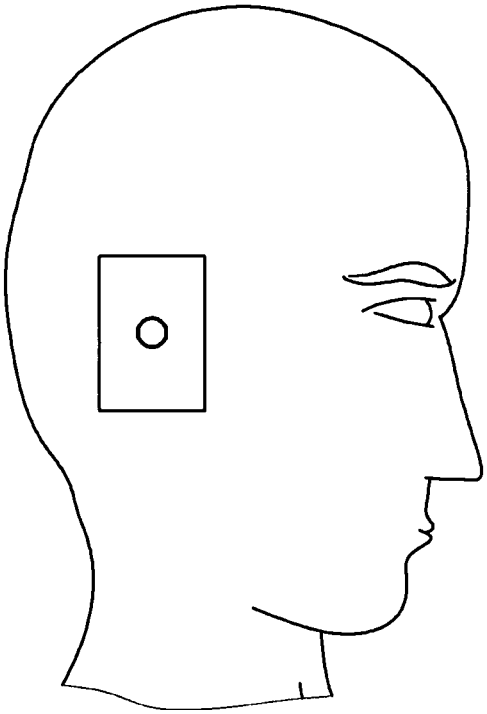
FIG. 4B is a diagram illustrating a dummy head without attached pinnae according to an embodiment of the present invention.

FIG. 4B is a diagram illustrating a dummy head without attached pinnae according to an embodiment of the present invention.

As illustrated in FIG. 4B, an HRIR measured by using the dummy head without attached pinnae does not include a second reflection sound wave reflected by pinnae.

Figure 4C:
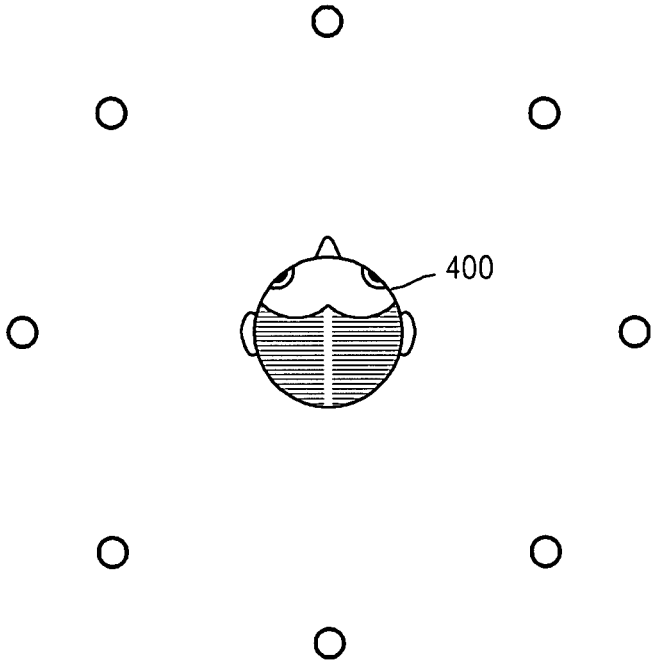
FIG. 4C is a diagram illustrating a head related impulse response (HRIR) measured with respect to changes in the position of a sound source according to an embodiment of the present invention.

FIG. 4C is a diagram illustrating a head related impulse response (HRIR) measured with respect to changes in the position of a sound source according to an embodiment of the present invention.

In order to localize a sound source to a predetermined position in space, an HRIR measured relative to a listener 400 with the position of the sound source moving is necessary. In this case, the position of the sound source can be expressed by an azimuth angle, that is, an angle on a plane expressed with reference to the listener 400. Accordingly, as illustrated in FIG. 4C, an HRIR is measured at each of the positions at which the sound source arrives when the azimuth angle with respect to the listener 400 changes, by using the dummy heads illustrated in FIGS. 4A and 4B.

Figure 5A:
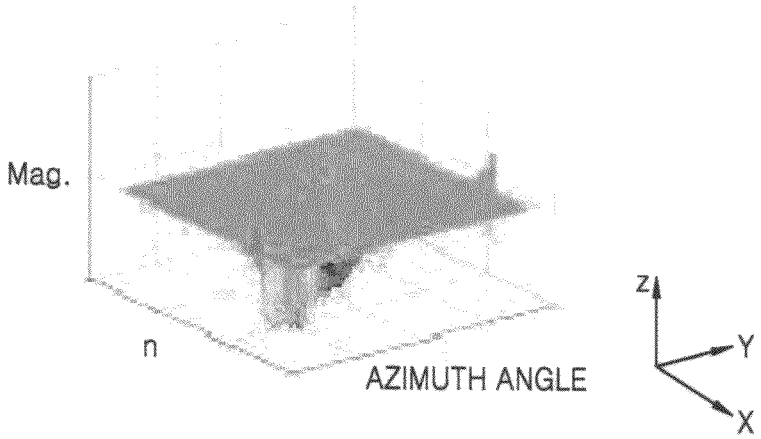
FIG. 5A is a graph illustrating an HRIR measured with respect to changes in the position of a sound source from a dummy head with pinnae attached thereto according to an embodiment of the present invention.

FIG. 5A is a graph illustrating an HRIR measured with respect to changes in the position of a sound source from a dummy head with pinnae attached thereto according to an embodiment of the present invention.

In the graph illustrated in FIG. 5A, the Z-axis indicates the magnitude of a sound pressure, the Y-axis indicates the azimuth angle expressing the position of a sound source on a plane, and the X-axis indicates the number of measured HRIR data items. In this case, since a sampling ratio is known, the X-axis may be replaced by time.

Figure 5B:
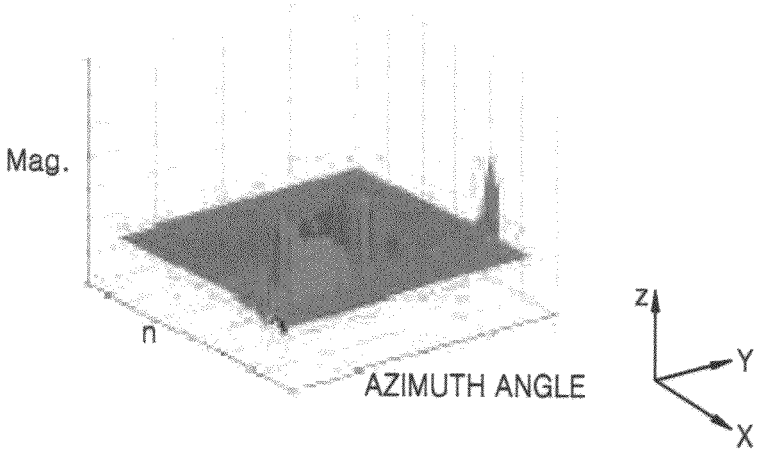
FIG. 5B is a graph illustrating an HRIR measured with respect to changes in the position of a sound source from a dummy head without attached pinnae according to an embodiment of the present invention.

FIG. 5B is a graph illustrating an HRIR measured with respect to changes in the position of a sound source from a dummy head without attached pinnae according to an embodiment of the present invention.

Figure 5C:
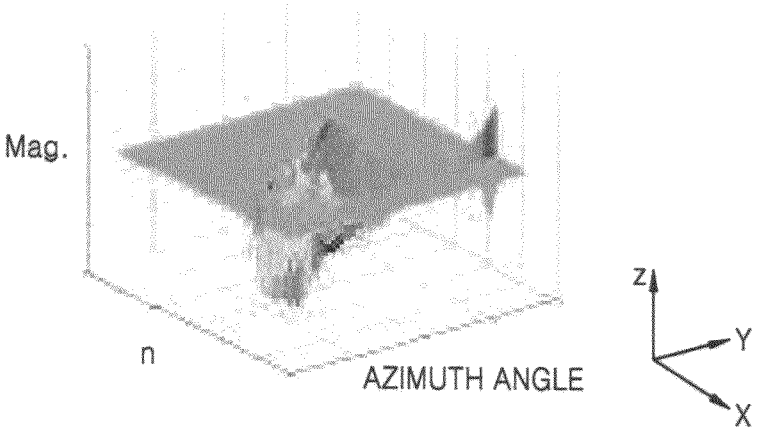
FIG. 5C is a graph of an HRIR showing a second reflection sound wave reflected by pinnae according to an embodiment of the present invention.

Data items illustrated in FIGS. 5A and 5B are data items from which ITD cross correlation indicating the difference between time delays at two ears is removed. FIG. 5C is a graph of an HRIR showing a second reflection sound wave reflected by pinnae according to an embodiment of the present invention. The reflected sound wave reflected by the pinnae, as illustrated in FIG. 5C, is obtained by subtracting the graph illustrated in FIG. 5B from the graph illustrated in FIG. 5A. That is, by subtracting the HRIR measured from the dummy head without attached pinnae from the HRIR measured from the dummy head with attached pinnae, the graph illustrated in FIG. 5C indicating the second reflection sound wave reflected by the pinnae can be obtained.

From the graph illustrated in FIG. 5C, information on the second reflection sound wave indicating the reflection sound wave reflected by the pinnae is extracted, and by using the extracted second reflection sound wave information, the second reflection sound wave model filter 310 illustrated in FIG. 3 is set. As illustrated in FIG. 3, the second reflection sound wave model filter 310 includes a plurality of gain and delay processing units respectively adjusting the gain and processing delays. The gain and delay processing units are set corresponding to the position of a sound source, and the gain value and delay value of the gain and delay processing units is modeled by using the distribution of a sound pressure indicating a highest sound pressure at each position of the sound source of the graph illustrated in FIG. 5C. In order to reduce the amount of data of gain values when modeling is performed, only 3 or 4 sound pressures from the highest sound pressure are considered.

In this case, the gain value and delay value at the gain and delay processing units can be expressed as equation 2 below:

$$\tau_{pn}(\theta)=A_n \cos(\theta/2)\cdot\sin[D_n(90°)]+B_n(90°\leq\theta\leq 90°) \quad (2)$$

Here, $\tau(\theta)$ indicates a delay processing value with respect to the position of a sound source and $\theta$ is an azimuth angle of the sound source, and $A_n$, $B_n$, and $D_n$ are values extracted from the graph illustrated in FIG. 5C.

Figure 6:
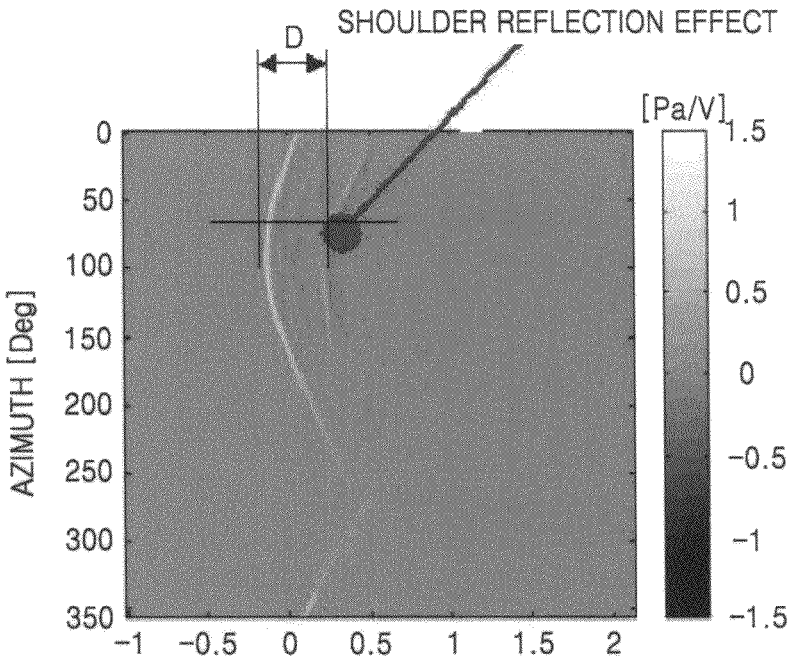
FIG. 6 is a graph illustrating a first reflection sound wave reflected by shoulders according to an embodiment of the present invention.

FIG. 6 is a graph illustrating a first reflection sound wave reflected by shoulders according to an embodiment of the present invention.

The graph illustrated in FIG. 6 is an HRIR measured by using a dummy head without attached pinnae, and expressed in relation to the position of a sound source, time, and sound pressure. As illustrated in FIG. 6, the sound pressure and time of a first reflection sound wave, which is generated when a sound wave generated at the sound source is reflected by the shoulders of a listener, varies with respect to the position of the sound source. Accordingly, from the graph illustrated in FIG. 6, information on the first reflection sound wave reflected by the shoulders of the listener is extracted, and by using the extracted first reflection sound wave information, the first reflection sound wave model filter 300 illustrated in FIG. 3 is set. From the graph illustrated in FIG. 6, a gain value and a delay processing value are extracted with respect to the position of the sound source, and the extracted values are stored in table form in a memory, thereby allowing the values to be used for a desired angle. That is, as illustrated in FIG. 3, the first reflection sound wave model filter 300 includes the gain processing unit 302 adjusting a gain and the delay processing unit 303 processing a delay, and from the gain values stored in the memory in table form, a gain value of the gain processing unit 302 is set, and from the stored delay processing values, a delay processing value of the delay processing unit 303 is set. Since the first reflection sound wave reflected by the shoulders is mainly generated from low frequency sound waves, the first reflection sound wave model filter 300 is equipped with the low pass filter 301, thereby filtering only a low frequency band signal, and the filtered signal is processed in the delay processing unit 302 and the gain processing unit 303.

Figure 7:
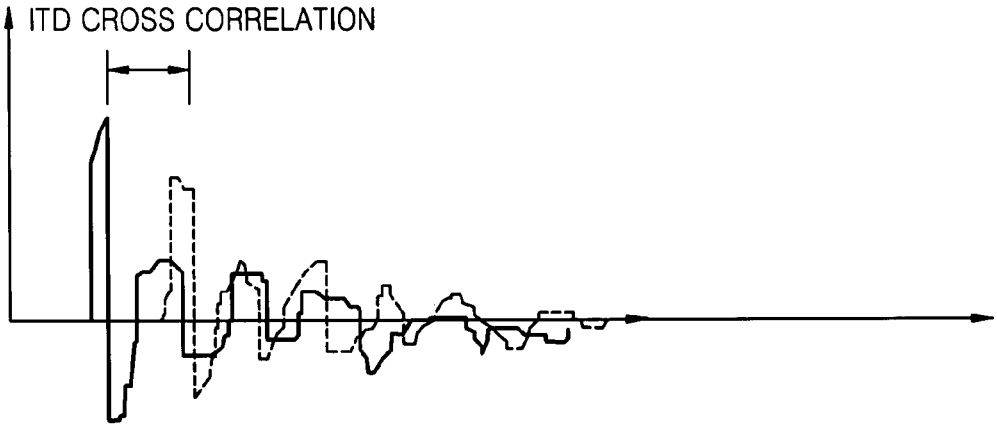
FIG. 7 is a graph for explaining a concept of interaural time difference (ITD) cross correlation used in an embodiment of the present invention.

FIG. 7 is a graph for explaining a concept of ITD cross correlation used in an embodiment of the present invention.

In the ITD cross correlation indicating the difference between times taken by a sound wave generated at a sound source, to arrive at two ears, HRIRs of two sound sources at different positions with respect to one ear are shown in FIG. 7. In this case, with reference to the position of one sound source, the difference between relatives times taken by a sound wave generated at the other sound source to arrive at one ear is the ITD cross correlation. That is, as illustrated in FIG. 7, a time corresponding to a largest magnitude at each of the reference HRIR and the other HRIR is detected, and the ITD cross correlation is extracted.

Figure 8A:
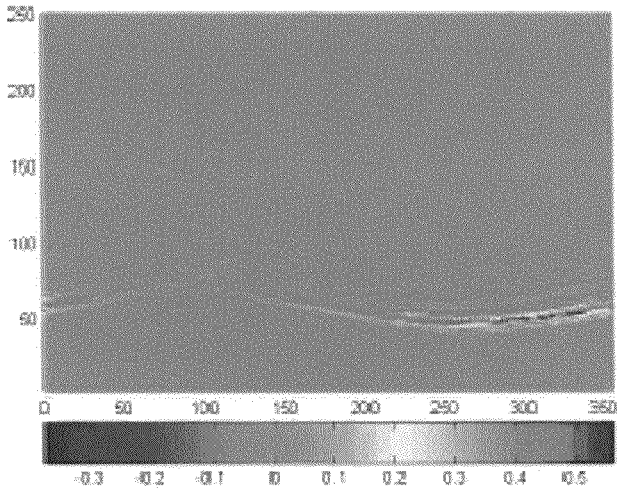
FIG. 8A is a graph illustrating an HRIR measured with respect to changes in the position of a sound source according to an embodiment of the present invention.

FIG. 8A is a graph illustrating an HRIR transferred to one ear with respect to the position of a sound source, by using the concept of the ITD cross correlation illustrated in FIG. 7. As illustrated in FIG. 8A, the HRIR transferred to the one ear shows values varying with respect to the position of the sound source.

Figure 8B:
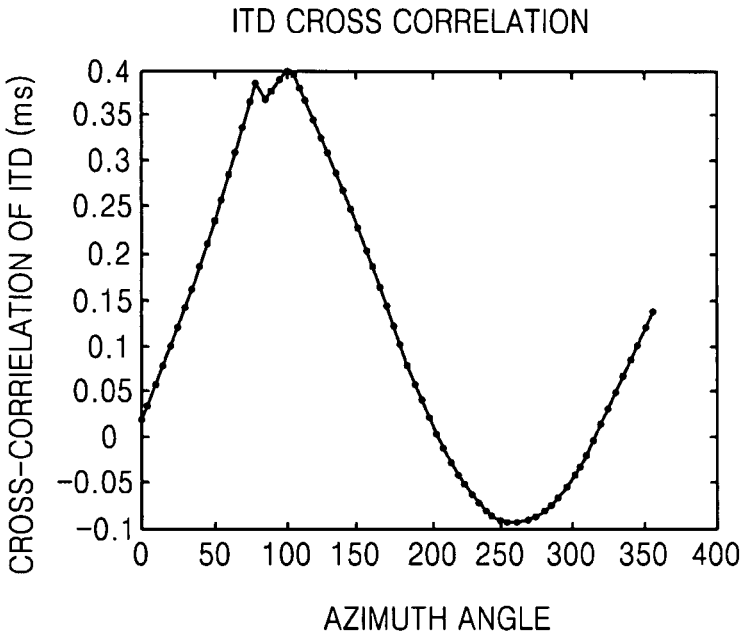
FIG. 8B is a graph illustrating ITD cross correlation extracted from an HRIR measured according to an embodiment of the present invention.

FIG. 8B is a graph illustrating ITD cross correlation extracted from an HRIR measured according to an embodiment of the present invention.

That is, FIG. 8B illustrates the ITD cross correlation that is the relative time differences of a sound source at the remaining positions with reference to one angle.

As illustrated in FIG. 8B, the ITD cross correlation varies with respect to the position of the sound source, and the shape is similar to a sine wave.

Thus, the graph of FIG. 8B illustrating the ITD cross correlation corresponding to the position of a sound source can be expressed as equation 3 below.

Figure 9:
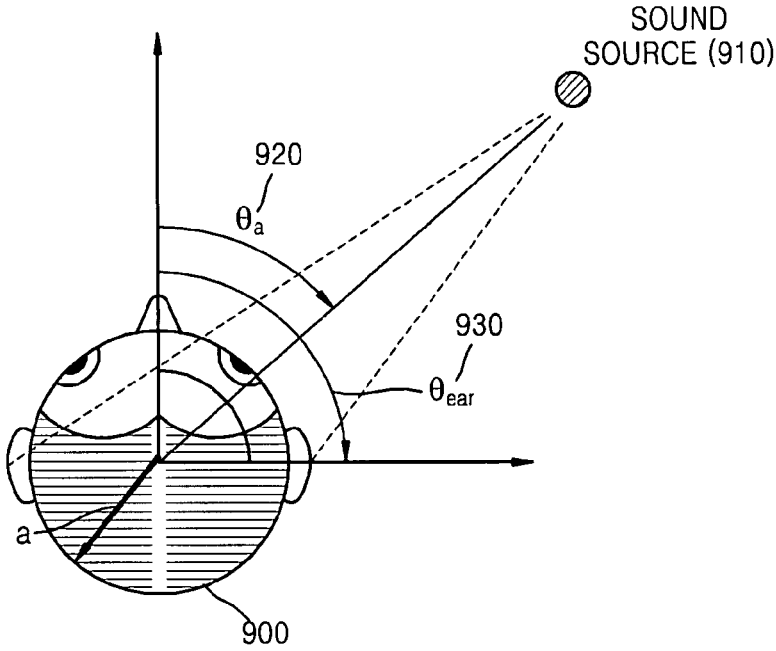
FIG. 9 is a diagram explaining an equation used to calculate ITD cross correlation according to an embodiment of the present invention.

FIG. 9 is a diagram explaining equation 3 according to an embodiment of the present invention.

Equation 3 will now be explained with reference to FIG. 9.

$$\Delta T(\theta)=\begin{cases} -\frac{a}{c}\cos\theta & \text{if } 0\leq|\theta|<\frac{\pi}{2} \\ -\frac{a}{c}\left(|\theta|-\frac{\pi}{2}\right) & \text{if } \frac{\pi}{2}\leq|\theta|<\pi \end{cases} \quad (3)$$

where, $$\theta=\theta_a-\theta_{ear}(=90°).$$

As illustrated in FIG. 9, in equation 3, a is the radius of the head of a listener 900, $\theta_a$ 920 is an azimuth angle indicating the position of a sound source 910 with reference to the front of the listener 920, and $\theta_{ear}$ is an azimuth angle indicating the position of an ear with reference to the front of the listener 900.

Accordingly, by using equation 3, a delay processing value of the delay processing unit (L) 221 delaying a signal corresponding to a left channel of the ITD model filter 220 and a delay processing value of the delay processing unit (R) 222 delaying a signal corresponding to a right channel are set.

Figure 10:
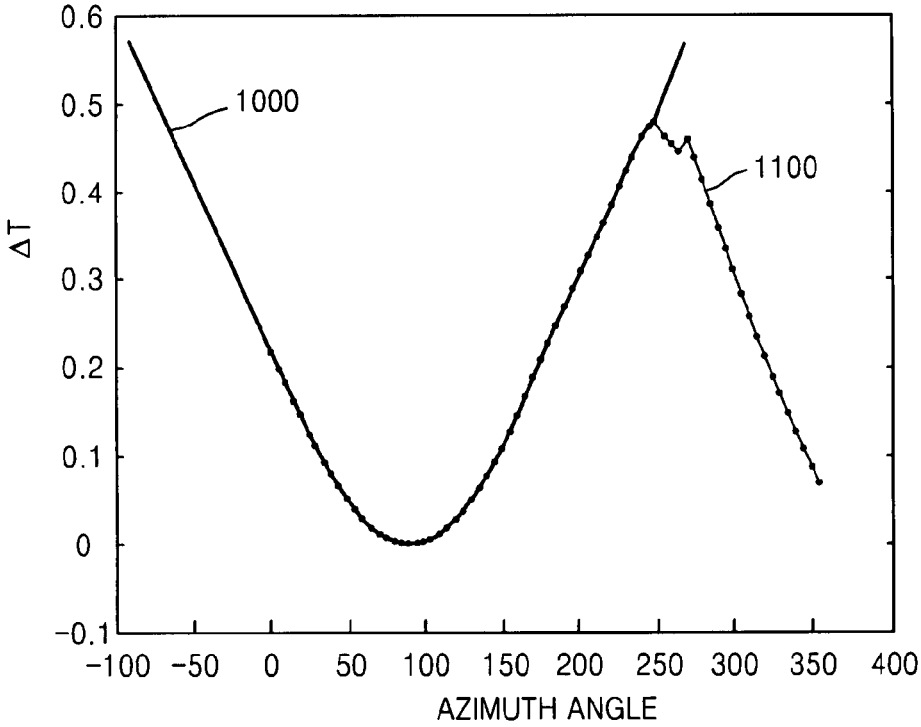
FIG. 10 is a graph comparing ITD cross correlation obtained by measuring with ITD cross correlation obtained by using an equation according to an embodiment of the present invention.

FIG. 10 is a graph comparing ITD cross correlation obtained by measuring with ITD cross correlation obtained by using equation 3 according to an embodiment of the present invention.

It can be determined that a graph 1000 indicating the ITD cross correlation obtained by using equation 3 is similar to a graph 1100 indicating the ITD cross correlation extracted from a measured HRIR as illustrated in FIG. 10.

Figure 8C:
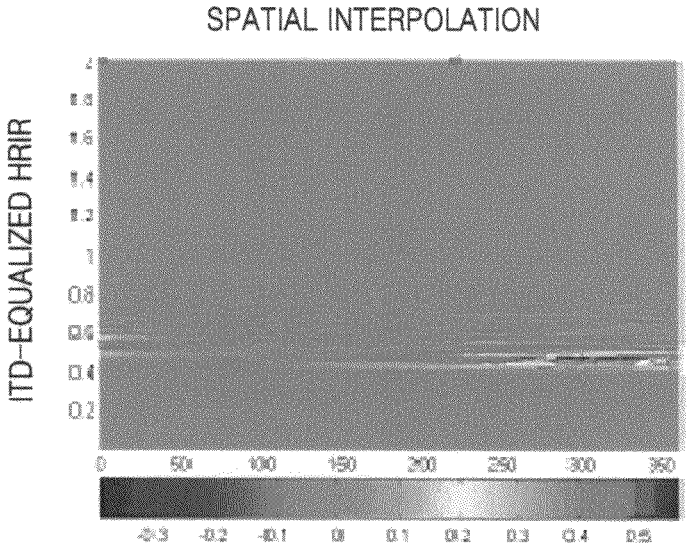
FIG. 8C is a graph obtained by subtracting ITD cross correlation from an HRIR measured according to an embodiment of the present invention.

FIG. 8C is a graph obtained by subtracting ITD cross correlation which is obtained by using equation 3 from an HRIR measured according to an embodiment of the present invention.

If ITD cross correlation with respect to changes in the position of a sound source is subtracted from an HRIR measured with respect to changes in the position of the sound source, the graph as illustrated in FIG. 8C can be obtained.

Figure 11:
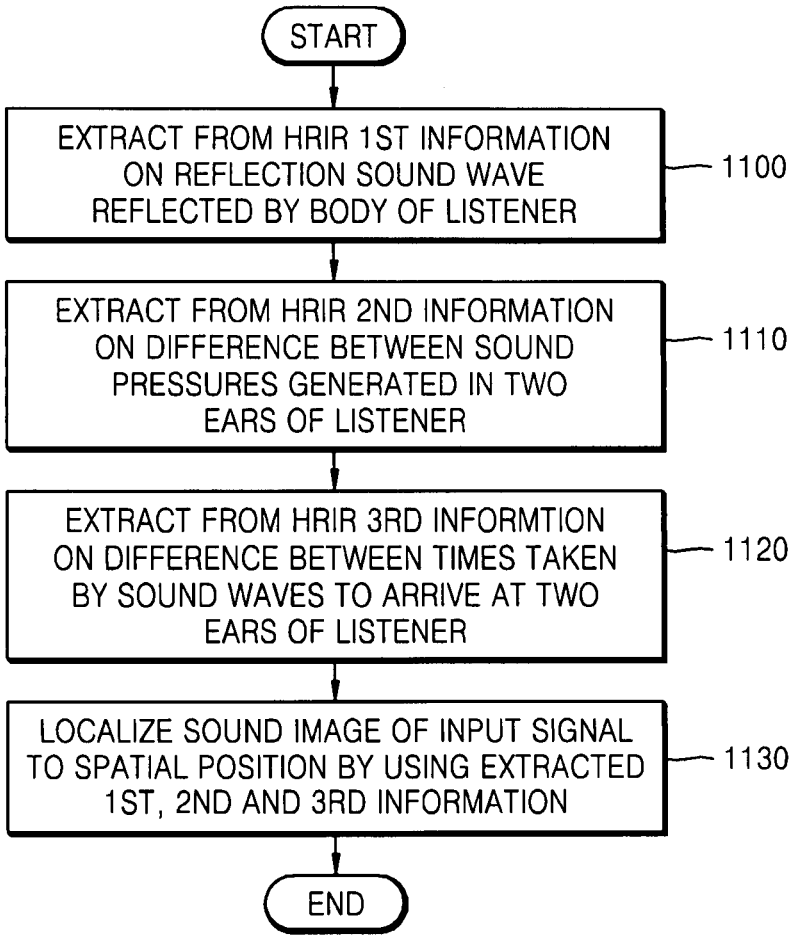
FIG. 11 is a flowchart illustrating a method of localizing a sound image of an input signal to a spatial position according to an embodiment of the present invention.

FIG. 11 is a flowchart illustrating a method of localizing a sound image of an input signal to a spatial position according to an embodiment of the present invention.

The method of localizing a sound image of an input signal to a spatial position according to the current embodiment will now be explained with reference to FIG. 3 illustrating the apparatus for localizing a sound image of an input signal to a spatial position.

In operation 1100, first information on a reflection sound wave reflected by the body of a listener is extracted from an HRIR. More specifically, as illustrated in FIG. 4C, the first information on the reflection sound wave is extracted from the HRIR obtained by measuring an impulse response generated at the position of a sound source moving with reference to the dummy head.

Figure 12:
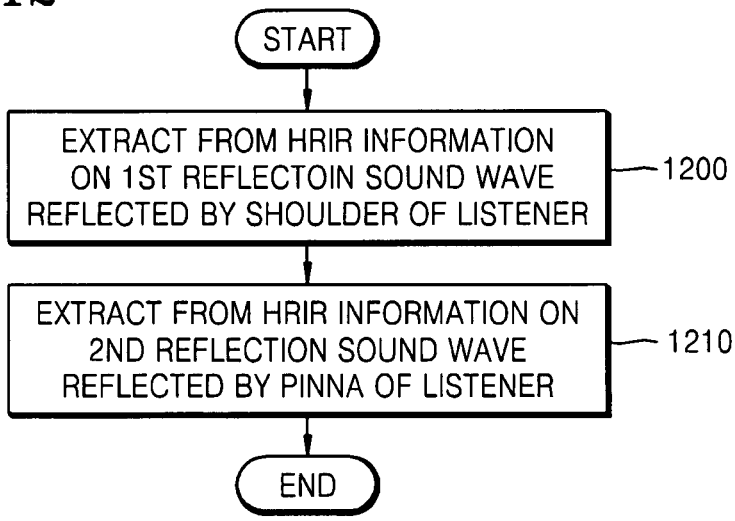
FIG. 12 is a flowchart illustrating a process of extracting information on a reflection sound wave reflected by a listener according to an embodiment of the present invention.

FIG. 12 is a flowchart illustrating a process of extracting information on a reflection sound wave reflected by a listener according to an embodiment of the present invention.

The process performed in operation 1100 of FIG. 11 will now be explained with reference to FIG. 12.

In operation 1200, information on the first reflection sound wave reflected by a shoulder of the listener is extracted from the HRIR. The sound pressure and time of the information on the first reflection sound wave varies with respect to the position of the sound source as illustrated in FIG. 6. Accordingly, information on the first reflection sound wave reflected by the shoulder of the listener is extracted by using the graph illustrated in FIG. 6. By using the extracted information on the first reflection sound wave, the gain value of the gain processing unit 302 and the delay processing value of the delay processing unit 303 of the first reflection sound wave filter 300, as illustrated in FIG. 3, are set.

In operation 1210, information on a second reflection sound wave reflected by a pinna of the listener is extracted from the HRIR. The information on the second reflection sound wave is as shown in the graph illustrated in FIG. 5C. Accordingly, information on the second reflection sound wave is extracted from the graph illustrated in FIG. 5C, and by using the extracted second reflection sound wave information, a plurality of gain and/or delay values of the gain and delay processing unit of the second reflection sound wave filter 310, as illustrated in FIG. 3, are set.

In order to set the gain and/or delay values, 3 to 4 sound pressures from a largest sound pressure in order of decreasing sound pressure at each position of the sound source of the graph illustrated in FIG. 5C are extracted, and the same number of values as the number of extracted sound pressures are set. However, since this number is determined in order to reduce the amount of computation in the current embodiment, it does not limit the number of sound pressures to be extracted.

Referring again to FIG. 11, in operation 1110, second information on the difference between sound pressures generated at the two ears, respectively, of the listener is extracted from the HRIR. The extracted second information is applied to the left channel and the right channel, respectively, thereby setting the gain values of the gain processing units 211 and 212 of the ILD model filter as illustrated in FIG. 3. In this case, the gain value for each of the left channel and the right channel is set, by using the sound pressure ratio of the two ears with respect to the sound source measured at one position in the frequency domain. The sound pressure ratio of the two ears is as illustrated in equation 1.

In operation 1120, third information on the difference between times taken for a sound wave to arrive at the two ears of the listener is extracted from the HRIR. In this case, the third information indicates ITD cross correlation, and therefore, the third information can be extracted from the graph illustrated in FIG. 8B. The graph of FIG. 8B, indicating the third information, can be expressed as equation 3. Accordingly, by using equation 3, the time delay values of the delay processing units 221 and 222 of the ITD model filter 220, as illustrated in FIG. 3, are set corresponding to the left channel and the right channel, respectively.

In operation 1130, the sound image of the input signal is localized to a spatial position, by using the extracted first, second, and third information. That is, the input signal is processed, by using the delay processing value and the gain value set by using the information extracted in operations 1100, 1110 and 1120, and the sound image of the signal is localized to a spatial position.

The present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet).

While the present invention has been particularly shown and described with reference to exemplary embodiments thereof, it will be understood by those of ordinary skill in the art that various changes in form and details may be made therein without departing from the spirit and scope of the present invention as defined by the following claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of localizing a sound image of an input signal to a spatial position, the method comprising:

extracting, from a head related impulse response (HRIR) measured with respect to changes in a position of a sound source, first information indicating a reflection sound wave reflected by a body of a listener;

extracting, from the HRIR, second information indicating a difference between sound pressures generated in two ears, respectively, when a direct sound wave generated from the position of the sound source arrives at the two ears, respectively, of the listener;

extracting, from the HRIR, third information indicating a difference between times taken by the direct sound wave to arrive at the two ears, respectively; and localizing a sound image of an input signal to a spatial position by using the extracted information, wherein the extracting of the first information further comprises setting a plurality of at least one of gain and delay values corresponding to changes in the position of the sound source from the extracted first information, the extracting of the second information further comprises setting a gain value corresponding to changes in the position of the sound source from the extracted second information, and the extracting of third information further comprises setting a time delay value corresponding to changes in the position of the sound source from the extracted third information, and in the localizing of the sound image of the input signal to a spatial position, by using the plurality of at least one of gain and delay values set from the first information, the gain value set from the second information, and the time delay value set from the third information, the gain of the input signal is adjusted, and the delay of the input signal is processed, thereby localizing the sound image of the input signal to the spatial position.

2. The method of claim 1, wherein in the setting of the gain value from the second information, the gain values corresponding to the changes in the position of the sound source are set corresponding to a left channel and a right channel, respectively, and in the setting of the time delay value from the third information, the time delay values corresponding to the changes in the position of the sound source are set corresponding to a left channel and a right channel, respectively, and the localizing of the sound image of the input signal to the spatial position comprises:

adjusting the gain of the input signal and processing the delay of the input signal, by using the plurality of at least one of set gain and delay values; and adjusting the gains of and processing the delays of the channels of the signal for which gain is adjusted and the delay is processed, by using the gain values and time delay values set corresponding to the left channel and the right channel, respectively, and thereby localizing the sound image of the input signal to the spatial position.

3. A non-transitory computer readable recording medium having embodied thereon a computer program for executing the method of claim 1.

4. A method of localizing a sound image of an input signal to a spatial position, the method comprising:

extracting, from a head related impulse response (HRIR) measured with respect to changes in a position of a sound source, first information indicating a reflection sound wave reflected by a body of a listener;

extracting, from the HRIR, second information indicating a difference in pressure between a sound pressure generated in a left ear and a sound pressure generated in a right ear, respectively, when a direct sound wave generated from the position of the sound source arrives at the left ear and the right ear, respectively, of the listener;

extracting, from the HRIR, third information indicating a difference between times taken by the direct sound wave to arrive at the left ear and the right ear, respectively; and localizing a sound image of an input signal to a spatial position by using the extracted information, wherein the extracting of the first information comprises:

extracting, from the HRIR, information on a first reflection sound wave indicating a reflection sound wave reflected by the shoulders of the listener; and extracting, from the HRIR, information on a second reflection sound wave indicating a reflection sound wave reflected by the pinnae of the listener, wherein in the extracting of the information on the second reflection sound wave, the information on the second reflection sound wave is extracted from the difference between a first HRIR measured from a dummy head with pinnae attached thereto and a second HRIR measured from a dummy head without pinnae attached thereto, wherein the extracting of the information on the first reflection sound wave further comprises setting a gain value and a time delay value corresponding to a change in the position of the sound source, from the extracted information on the first reflection sound wave, the extracting of the information on the second reflection sound wave further comprises setting a plurality of at least one of gain and delay values corresponding to changes in the position of the sound source from the extracted information on the second reflection sound wave, the extracting of the second information further comprises setting a gain value corresponding to a change in the position of the sound source from the extracted second information, and the extracting of the third information further comprises setting a time delay value corresponding to a change in the position of the sound source from the extracted third information, and the localizing of the sound image of the input signal to a spatial position comprises:

adjusting the gain of and processing the delay of the input signal, by using the plurality of at least one of set gain and delay values; and adjusting the gain of and processing the delay of the signal for which gain is adjusted and the delay is processed, by using the set gain value and time delay value, thereby localizing the sound image of the input signal to the spatial position.

5. The method of claim 4, wherein in the setting of the gain value corresponding to the change in the position of the sound source from the extracted second information, the gain value corresponding to the change in the position of the sound source is set corresponding to a left channel and a right channel, respectively, in the setting of the time delay value corresponding to the change in the position of the sound source from the extracted third information, the time delay value corresponding to the change in the position of the sound source from the extracted third information is set corresponding to a left channel and a right channel, respectively, and in the adjusting the gains of and processing the delays of the signal, thereby localizing the sound image of the input signal to the spatial position, adjusting the gains of and processing the delays of the channels of the signal for which gain is adjusted and the delay is processed, by using the gain values and time delay values set corresponding to the left channel and the right channel, respectively, and thereby localizing the sound image of the input signal to the spatial position.

6. An apparatus for localizing a sound image comprising:

a first filter device set by extracted first information after extracting, from an HRIR measured with respect to changes in the position of a sound source, the first information indicating a reflection sound wave reflected by the body of a listener;

a second filter set by extracted second information after extracting from the HRIR, the second information indicating the difference in pressure between a sound pressure generated in a left ear and a sound pressure generated in a right ear, respectively, when a direct sound wave generated from the position of the sound source arrives at the left ear and the right ear, respectively, of the listener; and a third filter set by third information after extracting, from the HRIR, the third information indicating the difference between times taken by the direct sound wave to arrive at the left ear and the right ear, respectively, wherein a sound image of an input signal is localized by using the set first through third filters, wherein the first filter comprises a plurality of gain/delay processing units each of which sets at least one of a gain and delay value corresponding to changes in the position of the sound source from the extracted first information, and adjusts a gain and processes a delay by using the at least one of set gain and delay values, and the second filter comprises a second gain processing unit setting a gain value corresponding to a change in the position of the sound source from the extracted second information and adjusting a gain by using the set gain value, and the third filter comprises a third delay processing unit setting a time delay value corresponding to a change in the position of the sound source from the extracted third information, and processing a delay by using the set time delay value, and the delay of the input signal is processed and the gain of the input signal is adjusted by using the at least one of delay and gain value set by the plurality of gain/delay processing units, and then, the gain of the signal is adjusted by the second gain processing unit of the second filter, and then, the delay of the signal is processed by the third delay processing unit of the third filter, thereby localizing the sound image of the input signal to the spatial position.

* * * * *